United States Patent [19]

Latin

[11] 4,174,808

[45] Nov. 20, 1979

[54] POOL FOUNTAIN

[76] Inventor: Edward Latin, 5357 Ridgevale Way, Fair Oaks, Calif. 95628

[21] Appl. No.: 844,615

[22] Filed: Oct. 25, 1977

[51] Int. Cl.[2] ..... B05B 17/08

[52] U.S. Cl. ..... 239/23

[58] Field of Search ..... 239/16–23

[56] References Cited

U.S. PATENT DOCUMENTS

| | | | |
|---|---|---|---|
| 179,977 | 7/1876 | Turrettini | 239/22 |
| 1,987,501 | 1/1935 | Andrews | 239/16 X |
| 2,412,326 | 12/1946 | Duduy | 239/59 X |
| 2,687,915 | 8/1954 | Keech | 239/18 |
| 3,030,028 | 4/1962 | Hruby, Jr. | 239/17 |
| 3,318,528 | 5/1967 | Williams | 239/17 |
| 3,722,816 | 3/1973 | Stewart et al. | 239/17 |
| 3,889,880 | 6/1975 | Hruby, Jr. | 239/18 |

*Primary Examiner*—Robert W. Saifer

*Attorney, Agent, or Firm*—Mark C. Jacobs

[57] ABSTRACT

A novel fountain device for a swimming pool is disclosed which features an adjustable jet pump for controlling the elevation of the water column as it is ejected from the fountain and the rise and fall of said column from a minima to a maxima.

9 Claims, 10 Drawing Figures

POOL FOUNTAIN

FIELD OF INVENTION

This invention relates to fountains for use in a swimming pool which may be connected to the water return line of the pool filter system or to the water input utilized in connection with a pool sweeping device.

BACKGROUND

Water fountains are considered to be esthetically pleasing, as part of a landscape or used in conjunction with swimming pools. Heretofore, most home fountains employed a separate pump station and a vessel in which a vertical riser was positioned such that water pumped through the pump station was emitted through the riser and recirculated back to the pump station. Such devices have been utilized for decorative pools, which are large enough to form part of an overall landscape as well as for portable fountains which are two or three feet in diameter for the water receiving and maintaining vessel. Generally such fountains have employed submersible pumps which are electrically operated. As such there is some degree of danger involved in their use in view of the presence of water in proximity of electricity. In addition, the problem of external wiring for backyards, etc. also exists.

As to the use of fountains in conjunction with swimming pools, very few of these are known to exist.

While the home swimming pool market is quite large today, it has only been in the last 20 years that the average man would consider owning a pool. As it is, most of the homeowner pools are situated in warm climate states such as California, Florida and Arizona. As such there has been minimal impetus to the industry to develop fountains for home use. Those that have been available have in the past incorporated that state of the art submergable electric pumps. Applicant is also aware of the fountain of Williams, U.S. Pat. No. 3,318,528 issued in 1967. In that patent, the fountain is seen to float on the top of the water, and the fountain apparatus is connected to the pool filter system by means of a flexible hose for coupling, in one version. A second version is located out of pool on a vertical wall connected with the water inlet stream.

Applicant is also aware of the Hruby U.S. Pat. No. 3,030,028. The inventive aspect of that patent is in the water ejector. That unit requires an anchor to be secured to a hose for resting in the bottom of the pool whereby the floating fountain is maintained in the desired area. The fountain, being substantially vertically above the anchoring device. One problem associated with that pool fountain is the fact that the water inlet means must be specifically designed to enter at the very bottom of the pool, whereas in present day pools the water inlet is normally less than two-and-a-half to three feet below the surface of the water.

Other problems that are encountered when employing conventional decorative water fountains for swimming pool use stem from the fact that such conventional fountains are not readily adapted for use in home swimming pools. Connections between the fountains and the source of water, i.e. the water inlet of the swimming pool under pressure, generally require separate hardware and complex plumbing. Both of these contribute to cost, which makes them uneconomical to market for the homeowner.

The instant invention comprises a significant advancement over the Hruby patent in that where proper plumbing exists, it is not required to employ a ballasting anchor, the movement of the fountain stream can be controlled, and its rise and fall can be adjusted such as to create a pleasing esthetic effect.

It is a primary object of the present invention to provide a novel swimming pool fountain which is readily connected to the pool filtering system and preferably to the inlet for a pool sweeping device.

Another object is to provide a swimming pool fountain that avoids the necessity for complex valving and other hardware. Still another object is to provide a swimming pool fountain that is readily detachable from the swimming pool water inlet means and is thus removeable from the swimming pool when its operation is not desired. Still another object is to provide a swimming pool fountain with a controlable undulating motion for the exiting column of water.

A further object is to provide a swimming pool fountain which is both low cost and which requires little or no maintenance. Yet a further object is to provide a fountain which will avoid spraying persons in the vicinity of the fountain but who are on the decking surrounding the pool.

One further object is to provide a fountain with an adjustably inclined riser such that the water column motion can be altered between undulating and arcuit.

SUMMARY OF THE INVENTION

The present invention accordingly comprises a means for attaching the fountain mechanism to the water egress line of either the filter system or the pool sweeping device which attachment mechanism basically comprises a quick disconnect tube such as those known in the art. This quick disconnect tube is connected to and communicates with a main pipe which is extended laterally away from the side wall of the swimming pool and which terminates in an elbow, which elbow is interconnected at one end to said main pipe and at the opposite end to a jet pump mechanism which terminates at the opposite end thereof in a riser, said riser being of such a length such as to protrude from the surface of the water. Optionally there may be included a ball valve mechanism for adjusting the inclination of the exiting water column from vertical to an angle less than vertical. In addition there may be included a means for adjusting the undulation by controlling the jet pump action.

The invention accordingly comprises the apparatus possessing the construction, combination of elements and arrangement of parts, which are exemplified in the following detailed disclosure on the scope of the application of which will be indicated in the appended claims.

For a fuller understanding of the nature and objects of the invention, one should make reference to the following detailed description taken in connection with the accompanying drawings.

In said figures, like numbers refer to like parts.

DETAILED DESCRIPTION OF THE PREFERRED EMBODIMENTS

Figure 1:
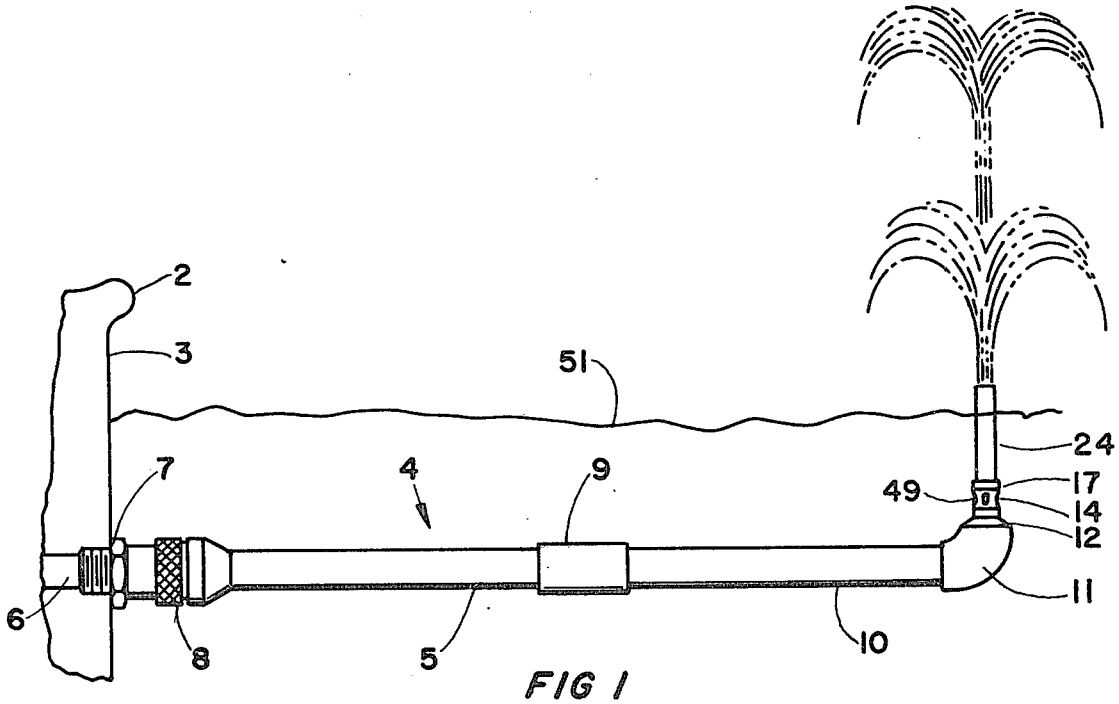
FIG. 1 is a vertical elevational view of one embodiment of the instant invention shown interconnected to the pool sweeping device water inlet.
Figure 4:
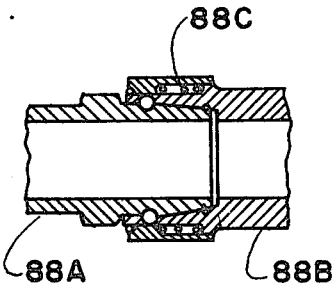
FIG. 4 is a cross sectional view of a quick disconnect member such as item 8 shown in FIG. 1.

There is shown in FIG. 1 a swimming pool fountain 1 which comprises a threaded connector 7 which is threadingly engaged to the pool sweeping device water inlet system 6, which is shown emerging from the vertical wall of the swimming pool 3. Item 2 is a coping stone which is seen to overhang the plastered sidewall of the swimming pool 3. The use of such coping stones is well known to the art. Secured to and interconnected with connector 7 is a quick-connective coupling. Such couplings are known to the art as straight through couplings, i.e. in that there is no shut off valve therein. Such couplings are manufactured by the Hansen Manufacturing Company, as well as Arneson Products, Inc. Such valves have a smooth unrestricted bore which permits the flow of fluid without any pressure drop. The plug portion is automatically locked in place when connected yet is readily disconnectable by pulling back of the socket sleeve. Refer particularly to FIG. 4 with respect to parts 88*a* and 88*b*. As shown in detail in FIG. 4, 88C O-ring seal present completely eliminates any possibility of leakage of the fluid, here water, from the coupling. Quick connect, also known as quick disconnect 8, communicates at one end with the threaded connector 7 and at the opposite end thereof to main pipe 5. Main pipe 5 comprises a tubular member composed preferably of schedule 40 PVC and it may vary in diameter from about one-half inch to about one inch in diameter. The preferred dimension is three-quarter inch pipe. Main pipe 5 may vary in length anywhere from about one foot to about three feet. Communicating with and sized slightly larger than main pipe 5 is connector 9. Connector 9 may be butt fitted and glued to main pipe 5 or may be threadingly engaged to said main pipe if said main pipe itself is threaded. Connector 9 is also preferably composed of poly vinyl chloride tubing. Generally connector 9 would be cast as a unit. Interconnected at the opposite end thereof there are the main pipe 5 secondary pipe 10. This too is preferably composed of schedule 40 PVC. It may vary in length from about one foot to about three feet. While PVC has been disclosed, it is also to be seen that the two pipes and the connector thereto and which communicates therewith to form an extended tubular member may be composed of any non-water permeable material which is preferably not subject to rust. Mention may be made of other schedules of poly vinyl chloride, copper, polyethylene, aluminum and stainless steel.

It is also within the scope of this invention to employ one singular tubular member which extends the length of the interconnected three units 5, 9 and 10 and which would be inter-connected on one end to the quick disconnect and on the opposite end thereof to an elbow, as is similar to item 10 in FIG. 1. If the total length of span from the quick disconnect to the elbow is less than one foot, the water column on emission from the riser as will be disclosed hereinafter will cause spatter of the water on to the decking, thereby wasting water, and also causing discomfort to viewers and a possible slippery deck member or slippery coping stone surface, unnumbered on item 2. It is also to be seen that main pipe 5 and secondary pipe 10 should be of similar cross-section such as to avoid any pressure drop or pressure increase. Interconnected to secondary pipe 10 and communicating therewith is elbow 11. Elbow 11 may be threadingly engaged or butt fitted and glued in place or otherwise secured to secondary pipe 10. Needless to say, as in any connection involving metal pipe, should this junction be of same as is known in the art, plumbers' putty should be employed. Both arms 5,9,10 and 5-9-10 join elbow 11 in like manner.

Figure 2:
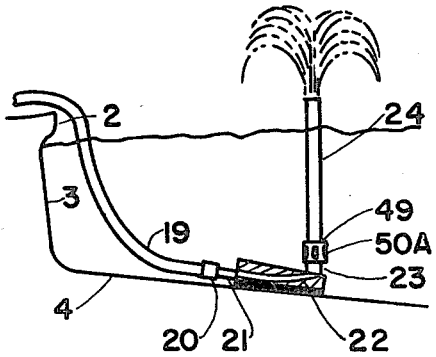
FIG. 2 depicts another embodiment of the instant invention which employs a ballasting means and is utilized for older swimming pools wherein the pool sweeping inlet device is plumbed on the outside of the pool.

At the opposite end of elbow 12 at a point substantially vertical to the bottom of the pool is positioned and rotatingly inter-connected thereto is the orientable ball valve 12. Item 12 is not the on and off type of ball valve normally contemplated by such term. Rather it is an angularly manipulable member for controlling the direction of the water column that will exit from the fountain. Such orientable valves are known to the art, and one variation of same is depicted in detail in FIG. 3 to be discussed below. Communicating with said ball valve at the opposite end thereof is jet pump 49. Jet pump 49 comprises a venturi tube, a term known to the art, and consists of a housing 17, an orientable annular collar 50B which is mounted in a set-in fashion in the lower end of housing 17 at one end, and is set-in at the other end of the equally dimensioned circular wall at the top end of ball valve 12. Jet pumps with such collars as 50A per FIG. 2 are well known to the art and details concerning same need not be set forth in view of the fact that they are purchasable in the open market. Suffice it to say, that 14 depicts an opening in said collar that communicates with the interior of said jet pump. The instant unit is seen to constitute one having four ports oriented in the same vertical plane and located at 90° from each other along the periphery of the jet pump.

As is known to the art such a venturi tube forces liquid to flow through a narrow passage at a rate much faster than normal such as to create a low pressure area in the supply tube namely here, the ball valve. Since the surrounding water is under normal pressure that is, the balance of the water in the zone outside of 14, and forming a part of the pool water, this surrounding water is sucked into the fast moving stream flowing through elbow 11 into ball 12 and into jet pump 49. This internal zone which has a lower pressure causes a suction of the surrounding exterior water to enter in through ports 14 and to exit from the top of the jet pump. Such water flows from the top portion of jet pump 49 into riser 24. Riser 24 may be threadingly engaged, with venturi housing 17 or it may be abutted and glued into place.

Figure 6A:
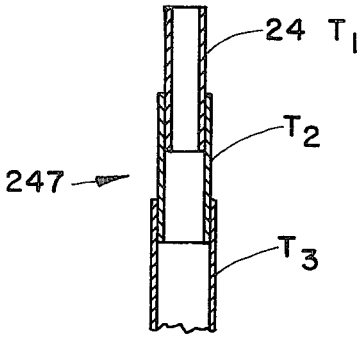
FIG. 6A is a sectional view of a telescoping riser through which the water is sprayed into the air.
Figure 6B:
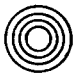
FIG. 6B is a top plan of the riser of FIG. 6A with the riser segments retraced inwardly.

Riser 24 may constitute a solid pipe or a telescoping pipe such as the one depicted at FIG. 6. Suffice it to say that riser 24 must be of such a length as to protrude above the surface of the pool water 51. The rise and fall of the water column, or undulation is controlled by the adjustment of the collar 50 (e.g. 50A or 50B) of jet pump 49. Also contributing to the rise and fall of the water columns, is the relative dimensions of ports 15 and 14 and the other two not shown, of said jet pump.

Figure 3:
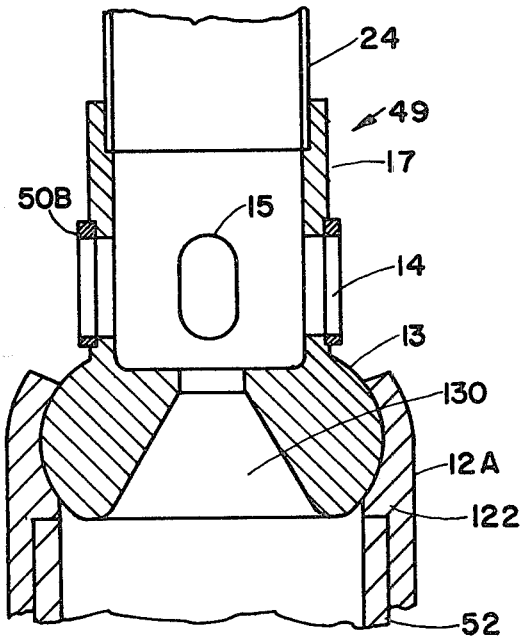
FIG. 3 is a cross sectional view of a variation of the jet pump portion of the fountain of FIG. 1.

While the instant jet pump is seen to have four ports, three of which are depicted in FIGS. 1 and 3, it is also within the scope of the invention to utilize a lesser or greater number of ports for the intake of secondary water. It is readily seen that the greater amount of suction that takes place, the greater amount of water will be intaken for egress through riser 24. With respect to the dimensions of the constricted portion of the jet pump, it is seen that the constriction should be approximately the size of the cross section of the top portion of the non-constricted segment of the jet pump. As would be anticipated, it would be within the scope of the invention to employ both a circularly moving collar, to open and close the venturi ports and a collar which is elevatable vertically to open and close said ports.

The advantage of utilizing a telescoping member for riser 24, is the fact that this is the easiest mode that the user can employ to ensure that the tip of riser 24 is above the surface of water 51. If not, due the fact that the water intake to the fountain is at a depth such that riser 24 will be below the surface of the water, then the undulating action will be significantly reduced as the emitting water column will be forced to pass through the surrounding water of the pool and as such the vertical force upward will be dampened. It is preferred that riser 24 should be about one inch above the top of the pool surface. This elevation is suggested such that the wave motion created on the surface due to the falling water, will not cause riser 24 to become submerged at any time.

If ball housing 12 is set at an angle that deviates from the vertical, it is seen that the undulating motion of the water column will be lost and that the water will egress from riser 24 in a normally arcuit pattern. To some users, this may be preferred.

While it has been indicated that members 5, 9 and 10 can constitute individual members or one unified structure, it is also to be seen that such unified structure can itself consist of telescoping members preferably designed to avoid any significant pressure drops as the column of water moves from left to right in the drawing. Thus one would be able to adjust the total distance from the outer edge of elbow 11 to the pool wall 3 from a minimum of about one foot to a maximum of about six to ten feet.

It is also in the scope of this invention to employ a suitable support cradle or other structure to support the fountain 1 of this invention in a generally horizontal-vertical plane such that the water moves through member 1, 9 and 10 horizontally and can egress from riser 24 in a substantially vertical manner. Such a support cradle may take the form of a common tripod having a V-shaped retainer portion to receive a tubular segment from 5,9, or 10 to retain it in the desired relative position.

In tests of the instant device, it was found that the water column would undulate a distance from a minimum of 11 feet to a maximum of 14 feet when one employed a riser of ¾ inches diameter and a venturi having a minimum cross section of ¾" with four venturi openings having 0.15 square inches each.

In addition to the esthetic undulating motion of the water column, it is seen that as the water falls downwardly onto the surface of the water 51 that a wave motion effect is created such as to change the appearance of the water surface from that of a ordinary smooth clear glass look to one slightly resembling an ocean in view of the waves that emanate from the point of entrance of the column water on its descent, outwardly to the edge of the pool.

FIG. 2 depicts a system wherein the fountain is plumbed to the water inlet of a pool sweep, which sweep is attached through external plumbing rather than internal plumbing. By the term external plumbing, is meant plumbing which is not below the ground level for entrance of return water to a pool sweeping device. In such situations, when the pool owner desires to use a sweeping device, it is necessary to have plumbing from the filtration system to the pool sweeping device above ground. Normally this is done through the use of a flexible hose. As shown in FIG. 2, item 19 is such hose and item 20 is a connector between the fountain mechanism and such hose. Connector 20 may comprise a quick disconnect coupling such as is shown in FIG. 1 or, it may be a permanent attachment which may be secured as by the use of threads and/or adhesive. Connector 20 may when intended to be a permanent attachment be constructed of metal or plastic such as poly vinyl chloride. Interconnected at the opposite end of 20 and communicating therewith in like manner as 20 communicates 19, is main pipe 21. Main pipe 21 is inserted through ballasting means 22 and is joined at an angle such that short riser 23 will be inclined in a substantially vertical position. It is seen that ballasting means 22 can comprise any unit known to the art for lending weight to the fountain device, such that the device will rest upon the floor of the pool contrary to the embodiment shown in FIG. 1. Ballasting device 22 may be comprised a chamber into which may be placed stones, pebbles, concrete or any other material which will lend weight to the ballasting means. Such ballasting means may be hollowed out for passage of main pipe 21 in a specific manner to accomplish said desired result, or item 21 may be inserted therein through an opening at the side wall of means 22 such that the riser and other vertical standing members will assume a position substantially vertical. Included within the confines of ballasting means 22 may be a separate elbow, to interconnect parts 21 and 23, though not shown in the drawings, or item 21 may be angularly bent at one end thereof to form a continuous member from the point of interconnection with member 20 and jet pump 49. The bending of such pipe means is readily known to the art.

Figure 7:
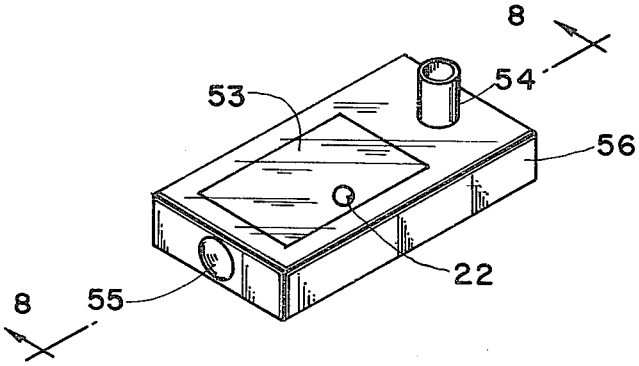
FIG. 7 is a perspective view of the ballasting means utilized in FIG. 2.

In further description of ballasting means 22, it is seen that it may be configured in any shape or fashion, here rectangularly with an inlet at one end and an outlet disposed 90° from the inlet. Such inlet and outlet sections are for the passage of main pipe 21 and small riser 23, which may be either separate parts or joined together to form one master part as previously discussed. In the alternative, however, ballasting means 22 may be moulded as one segment wherein provision is made internally for a built in tubular member forming part of the actual design of the part. Such tubular member would communicate with 21 and with 23. Ballasting means 22 may be cast as one heavy part which has its own weight in the area not occupied for passage or comprising a passage, for the water from the filter system to be sprayed into the air. More details of ballast means 22 are shown in FIG. 7. In such FIG. 7 it is seen that a rectangular cross sectional member is provided in this perspective view wherein an entrance and an exit portion are provided. These two portions communicate internally and not shown in the figure. The communication is through a bore from one point of egress to the other. This passageway for communication from the point of entrance to the point of exit, should be sized the same as the main pipe 20 such that no loss of pressure takes place. Shown also at the top surface thereof is an entry door 53 into which is placed the ballasting material such as sand or gravel.

Shown emerging from the exit point of ballast means 52 on the top surface thereof is short riser 23. Short riser 23 communicates with the internal passageway 22 on one end and with the jet pump 49 at the opposite end thereof.

FIG. 3 represents a close up view of a slightly different embodiment of a portion of the invention shown in FIG. 1. The sectional view depicts a portion of a member 52 which either emanates from or is in fact elbow 11. Housing 12A of part 49 is sized dimensionally slightly larger than the diameter of member 52, and both being circular in cross section, such that **12*a* can be overlaid in frictional engagement with 52, such that edge 122 rests upon the lip of member 52**. In view of the presence of high pressure, adhesion of one part to the other is recommended, or a threaded engagement not shown may be employed.

Part 49 is a ball valve, which can be freely oriented angularly to alter the direction of the water flowing therethrough. The orifice 130 communicates with the internal opening of member 52 and throat 131. Due to the downward force upon the horizontal pipes 1, 9, 10, that causes the horizontal pipe unit, the arm, to become angularly disposed rather than substantially horizontally disposed. For a situation such as this, it may be beneficial to reverse the downward moving tendency by compensating via angular adjustment such that the effect is that the water stream will exit vertically. The ball portion of 49 is designated 13, while the rigid tubular portion that adjoins same is designated 17.

The nonhatched rectangular area with the aperture 15 represents the inside wall of tubular portion 17. Collar 18 orients within the notched out sections of tubular 17, in circular fashion, to open and close and plurality of apertures 15 of portion 17. When apertures 14 of collar 18 are circularly oriented to alignment with aperture(s) 15, then water is free to enter from the environment which mixes with the internal water already under low pressure having just come through the venturi throat 130 and the external water does in fact rush in, causing the ultimately emitted water to egress under more pressure than when collar 18 is oriented such that there is no alignment of the orifices 14 and 15 such that no jet pump action transpires. One or more apertures can be employed in the jet pump. Preferably two or more. Here two are employed.

Riser 24 is sized dimensionally smaller than tubular portion 17 such that it can be inserted therein. Riser 24 may be frictionally engaged, threadingly engaged or adhered into portion 17 of combined ball valve tubular member 49.

FIG. 4 is a sectional view of a typical quick disconnect flow through valve 8, wherein the parts are designated **88*a* and 88*b***. As indicated previously such devices are known to the art.

Figure 5:
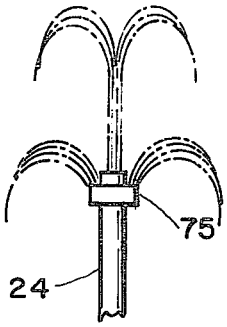
FIG. 5 depicts the undulating motion of the water column which exits from the instant fountain.

FIG. 5 is a perspective view showing a portion of riser 24 and the undulating stream that is emitted from the riser due in part to the jet pump action upon the water of the fountain. See details below. Optional nozzle 75 is also shown.

FIG. 6 depicts an alternate form of riser 24 designated 247. In this form, a plurality of units telescope into each other such that the total altitude is alterable at will. It is seen that each T segment upon extension can snap into a maximum extension position if such is desired, and which is within the skill of the art to design, such telescoping legs being known to the photographic field for tripods. It is seen however that as shown in FIG. 6A the top plan view, that since the diameter is reduced from segment $T_3$ to $T_2$ that there will be a slight pressure drop from segment to segment.

The ballast device 22 shown in perspective in FIG. 7 comprises a body section 56 having an entryway 55 and an egress area 54. Connecting these internally is a bent pipe member not shown. Both 54 and 55 may be threaded optionally to receive connector 20 and small riser 23. In any event 20 and 23 are sized to be secured into 55 and 54 respectively, and to communicate internally therewith and through the bent pipe member, unnumbered, to each other for the continuous passage of fluid. Door 53 is suitably hinged, and has a suitable closure means, both not shown, such that it can be opened to the internal chamber of body section 56. Since 55 and 54 are connected by a closed tube, it is seen that when door 53 is shut that the internal chamber is secure and tight. Ballast material such a gravel, marbles, etc. may be placed in said chamber to act as a weight to maintain ballast means 22 at the bottom of the pool in a correctly oriented position, as shown in FIG. 2.

The bent pipe member should preferably be about the same diameter as both 20 and 23 to avoid pressure changes.

Body 56 is made preferably of high impact plastic or stainless steel.

Figure 8:
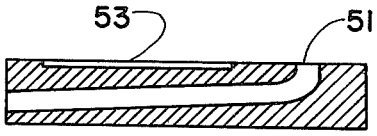
FIG. 8 is a longitudinal cross sectional view of the ballasting means of FIG. 7 along the line 8—8 of FIG. 7.

FIG. 8, the sectional view, shows the portion of the pipe within the interior chamber of ballasting means 22. It is seen that said pipe 51 communicates with openings in two walls of the body of the ballast means. The pipe is not accessible from the interior of the body. Door 53 is intended for the introduction of ballast which will freely flow around the pipe which is suspended between the two bodywall openings. Since there are no other openings in means 22 the filter material is maintained in the interior chamber of said device 22 when the door 53 is closed. As is seen the two wall openings are in the end wall and the top wall.

Figure 9:
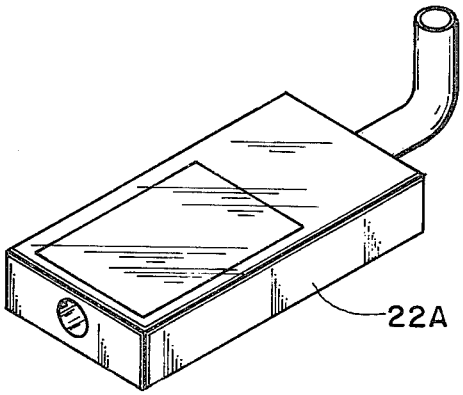
FIG. 9 is a perspective view of an alternate ballasting means showing the use of a separate elbow to alter the direction of fluid flow.

FIG. 9 depicts an alternate ballast device **22*a*** wherein the body openings are located on end walls and a separate hollow means for altering the direction of the fluid flow is employed; typically an elbow.

As has been indicated briefly in connection with the discussion of FIG. 5, that in the embodiment of FIG. 1, the exiting water will oscillate back and forth in an undulating motion. This phenomenon arises due to the fact that the horizontal portion of the fountain (the arm) is cantilevered away from its point of attachment to the wall of the pool. The water flowing therethrough causes the arm to vibrate slightly vertically. The force of gravity acting on the arm tends to force the arm downward from the horizontal. In addition, the water exiting from riser 24 is moving upward, and since for every action there is an opposite reaction, so too riser 24 is being pushed down vertically. Thus it is seen that the oscillation is due to the presence of opposing forces.

It is seen further that since the vibrations up and down are taking place in a fluid environment heavier than air, the vibrations are dampened. Also the thrust of the existing water vertically is dampened in that the surrounding environment is water. However since the placement of the riser is such that it is just at or slightly above the surface of the water, the vibrating forces and the movement of the pool water surface will cause the riser 24 to bob above the water surface every few seconds. When this happens, the exiting water can go higher due to "free" surroundings of air, then as the riser descends, the exiting water is dampened, thereby contributing to the oscillating effect of the fountain.

One should not form the opinion that the vibrations of the arm of the fountain are that significant. Rather, the oscillations of the exiting stream arise, due to the combination of the vibrations, the placement of the top of the riser at or near the water surface and the third fact that the exiting stream creates a wave like motion on the surface of the water which spread out like ripples from this focal point in all directions to the walls of the pool as the stream descends into contact with the pool surface. These ripples not only contribute to the esthetics of the pool and fountain, but also the ripples cover over the riser thus contributing to the dampening effect discussed above.

It is seen that the vibrations, the overall dampening, and the heights (maximum and minimum) of the exiting water column are all influenced by the length of the arm, the height of the riser, the velocity of the flowing water and the pressure increase created by the specific venturi employed.

While mentioned briefly in connection with the discussion of FIG. 5, it is seen that nozzle 75 secured to the top of riser 24 may be of any desired configuration as to its exiting portion. That is, it can create a fan shape, circular shape or any shape or any shape of spray desired, from one or more apertures. All of this is well known to the art. Nozzle 75 may be press fit, adhesed or threadingly engaged to riser 24 when such nozzle is employed.

While it has been indicated that the instant fountain may be utilized with a water return line from the pool filter or the pool sweeping device line, even though the latter requires attachment and reattachment, it is preferred, since the sweeper operates with a higher pressure than the ordinary return line. Of course, when plumbing a new pool, one can build a separate line for operation of the fountain.

Though not discussed in detail above, it is readily recognized by those familiar with the pool art that underwater inlet 6 of FIG. 1 communicates with and cooperates with the other parts of the recirculating water filter system of the pool which are not shown in the Figure. Such filter system includes a conventional motor, pump filter and interconnecting plumbing. The filter system includes a water return line which returns water to the pool after it has been filtered, and optionally a high pressure water return line used to operate a pool sweeping device as the Pool-Sweep® made by Arnesson in California. Preferably line 6 is of the latter nature since high pressure contributes to the better performance of the fountain.

It is also seen that while the main pipe 5 is shown connected to the connector 7 via quick disconnect 8, it is also within the scope of the invention to omit this part and to have main pipe 5 (or arm 5910) connected directly to connector 7. This can be accomplished when the pool is plumbed for a sweep, but the owner does not have one, or when the pool is plumbed ab initio for the instant fountain or when the fountain is to be attached to a return water line.

It is further seen that elbow 11 need not be, but preferably is, bent 90°. If not, a vertical shooting column of water is desired, the angular difference can be made up by proper orientation of the ball valve.

An optional nozzle to form the emitting water stream into into a fan or other shape may be employed. This would be attached to the open end of said riser by threads, friction or glue and would be disposed at or just above the level of the water. When such is employed, it may be necessary to shorten the riser to assume desired vertical disposition of the nozzle. Such a nozzle is illustrated in FIG. 5 and labelled 75.

While elbow 11 is shown in FIG. 1, any hollow means for altering the path of fluid flow from a horizontal to a vertical one, such as an L connector or even an angular bend on one side of secondary pipe 10 may be employed to achieve the desired result.

In recapitulation, it is seen that the major component of the instant invention is the use of the venturi action to give rise to the spectular visual effect. The pressure differential causes the mass insurgence of water from the pool, ie. outside of the venturi tube to be sucked in and urged upwardly at high speed. Absent the jet pump action, for a normal 20 psi of pressure pump the water column would rise about 4 to 6 feet. With the instant inventive fountain however, the column will rise from 14 to 20 feet, with a wide stream. The above distances are measured from the surface of the water. The stream as shown in FIGS. 1 and 5 is about one inch diameter at the narrow points. At the top of incline, the stream spills over onto itself creating a flow of water 2 to 3 feet wide, in what is defined here as the mushroom cap area. In FIG. 1 and FIG. 5 two mushroom caps are shown. In practice, more of such may occur. These are caused by the undulations of the stream as explained aforesaid, with each mushroom cap area being the spilling over of the stream onto itself as some particular elevation at a particular moment in time.

It is seen that no "special" plumbing or valving is needed to enjoy the fountain of this invention, just a line for water to operate a pool sweeping device under pressure, or a separate line exclusively for this purpose connected to the pool filter pump or more expensively to its own pump means.

Since there are no moving parts, and no critical requirements, the instant fountain may be manufactured primarily of polyvinyl chloride, which is low in cost and readily available.

While the instant fountain has been primarily described as being removeably secured to the pool sweeping device's water line, it can if desired be permanently attached to the pool plumbing, if a separate water line is provided exclusively for the fountain.

Obviously the exact altitude of the column of water will vary with the pressure on the line and the diameter of the orifice of the venturi jet, and diameter of the line. If a stronger pump other than what is conventionally used for pool sweeping devices is employed, the resultant fountain flow will be a taller stream with a wider body (mushroom cap).

Since certain changes may be made in the above article without departing from the scope of the invention involved herein, it is intended that all matter contained in the above description and shown in the accompanying drawings shall be interpreted as illustrative only and not in a limiting sense.

I claim:

1. A fountain for a swimming pool comprising:

(a) an extended tubular arm having a quick disconnect flow through valve connectable on one side to an underwater swimming pool water inlet on the first end of said arm, (b) hollow means for altering the path of fluid flow from generally horizontal to generally vertical connected on one side to the other end of said arm, (c) an orientable flow through ball valve disposed between and connected to said hollow means on one end, (d) a jet pump having at least one aperture, and being connected at one of its two ends to said ball valve, said pump including a rotatable collar to adjustably close the apertures of said pump, (e) a rigid riser generally vertically disposed and having a first end and a second end; the first end connected to said jet pump's second end, all of said parts communicating to form a conduit for a stream of water.

2. The fountain of claim 1 wherein said riser comprises a plurality of telescoping tubular sections for altering the elongation of said riser.

3. The fountain of claim 1 further including a nozzle secured to the second end of said riser.

4. The fountain of claim 1, wherein the jet pump has a plurality of apertures all of which are adjustably closeable.

5. In combination:

a swimming pool a recirculating filter system for said pool including a water return line through which filtered water is returned to the pool, and the swimming pool fountain of claim 1, said fountain being operatively connected to said filter system.

6. The fountain of claim 1 wherein the orientable ball valve and the jet pump are a unitary structure.

7. A swimming pool fountain comprising:

(a) an extended tubular arm connectable at a first end to a water inlet for a swimming pool, (b) ballasting means fluidly connected to said arm wherein said ballasting means includes a hollow means therein for altering the path of fluid flow from generally horizontal to generally vertical, (c) a jet pump having at least one aperture, including means to adjustably close said at least one aperture, said jet pump having two ends and being connected at one of its two ends to said hollow means, (d) a rigid riser generally vertically disposed having a first end and a second end, the first end of which is to said jet pump's other end.

8. The fountain of claim 7 wherein said riser comprises a plurality of telescoping tubular sections for altering the elongation of the riser.

9. In combination:

a swimming pool a recirculating filter system for said pool including a water return line through which filtered water is returned to the swimming pool, and the swimming pool fountain of claim 7, said fountain being operatively connected to said filter system.

* * * * *